US008251351B2

(12) United States Patent
Roodenburg et al.

(10) Patent No.: US 8,251,351 B2
(45) Date of Patent: Aug. 28, 2012

(54) TRACTION WINCH

(75) Inventors: Joop Roodenburg, Delft (NL); Pieter Dirk Melis Van Duivendijk, Missouri City, TX (US)

(73) Assignee: Itrec B.V., Schiedam (NL)

( * ) Notice: Subject to any disclaimer, the term of this patent is extended or adjusted under 35 U.S.C. 154(b) by 0 days.

(21) Appl. No.: 12/674,868

(22) PCT Filed: Aug. 24, 2007

(86) PCT No.: PCT/NL2007/000207

§ 371 (c)(1),
(2), (4) Date: Mar. 11, 2011

(87) PCT Pub. No.: WO2009/028927

PCT Pub. Date: Mar. 5, 2009

(65) Prior Publication Data

US 2011/0147684 A1 Jun. 23, 2011

(51) Int. Cl.
*B66D 1/22* (2006.01)

(52) U.S. Cl. ..... 254/297; 254/278

(58) Field of Classification Search ..... 254/278, 254/293, 294, 295, 297, 316, 342, 344
See application file for complete search history.

(56) References Cited

U.S. PATENT DOCUMENTS

| | | | | | |
|---|---|---|---|---|---|
| 4,058,295 | A * | 11/1977 | Morfitt | 254/291 |
| 4,065,101 | A * | 12/1977 | Korkut | 254/295 |
| 4,236,696 | A | 12/1980 | Hicks et al. | |
| 4,461,460 | A * | 7/1984 | Telford | 254/344 |
| 4,736,929 | A * | 4/1988 | McMorris | 254/344 |
| 4,921,219 | A * | 5/1990 | Ottemann et al. | 254/284 |
| 5,906,325 | A * | 5/1999 | Harrison, Jr. | 242/364.11 |
| 6,182,915 | B1 | 2/2001 | Kvalsund et al. | |
| 7,175,163 | B2 * | 2/2007 | Blanc | 254/278 |
| 7,270,312 | B1 * | 9/2007 | Phipps | 254/297 |
| 7,461,832 | B2 * | 12/2008 | Zhang | 254/278 |
| 7,766,307 | B2 * | 8/2010 | Urciuoli | 254/374 |

FOREIGN PATENT DOCUMENTS

| | | |
|---|---|---|
| FR | 1 465 703 A | 3/1967 |
| FR | 2 377 962 A1 | 8/1978 |
| GB | 835 060 A | 5/1960 |

* cited by examiner

*Primary Examiner* — Emmanuel M Marcelo

(74) *Attorney, Agent, or Firm* — Birch, Stewart, Kolasch & Birch, LLP

(57) ABSTRACT

A traction winch for a cable or the like includes a winch frame, at least two sheave assemblies each having at least a first sheave and a second sheave, each sheave having a single circumferential friction surface for the cable. The winch further includes at least two rotatable driveshafts, journalled in the winch frame in a side-by-side arrangement, each drive shaft being associated with a sheave assembly, and at least one motor for driving the driveshafts. The winch includes a differential assembly being provided between each driveshaft and sheave assembly so as to allow for different rotational speeds of the sheaves during operation of the traction winch due to cable elongation.

19 Claims, 5 Drawing Sheets

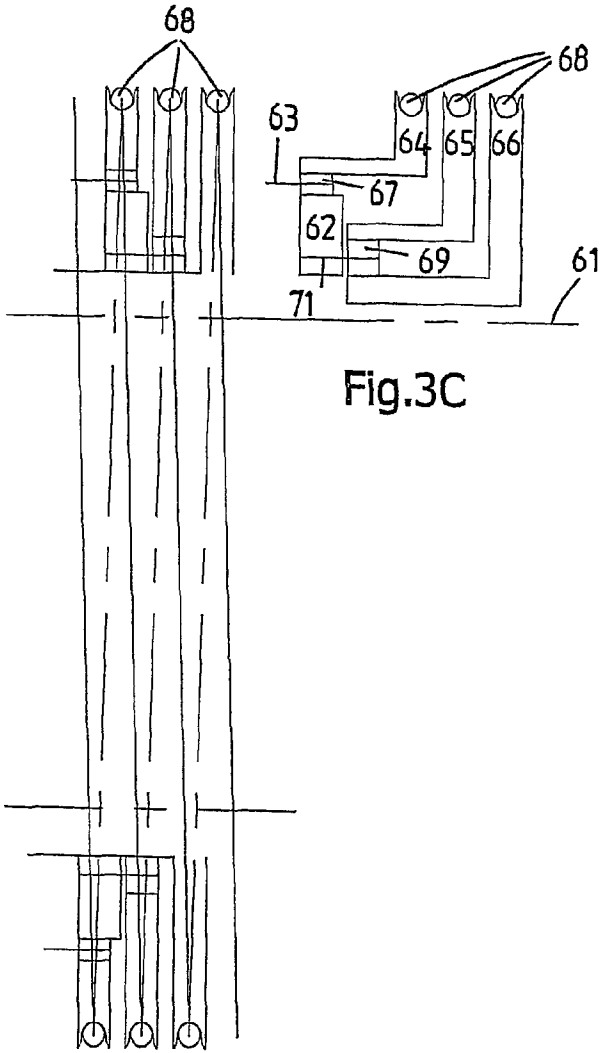
Fig.3C
Fig.3B
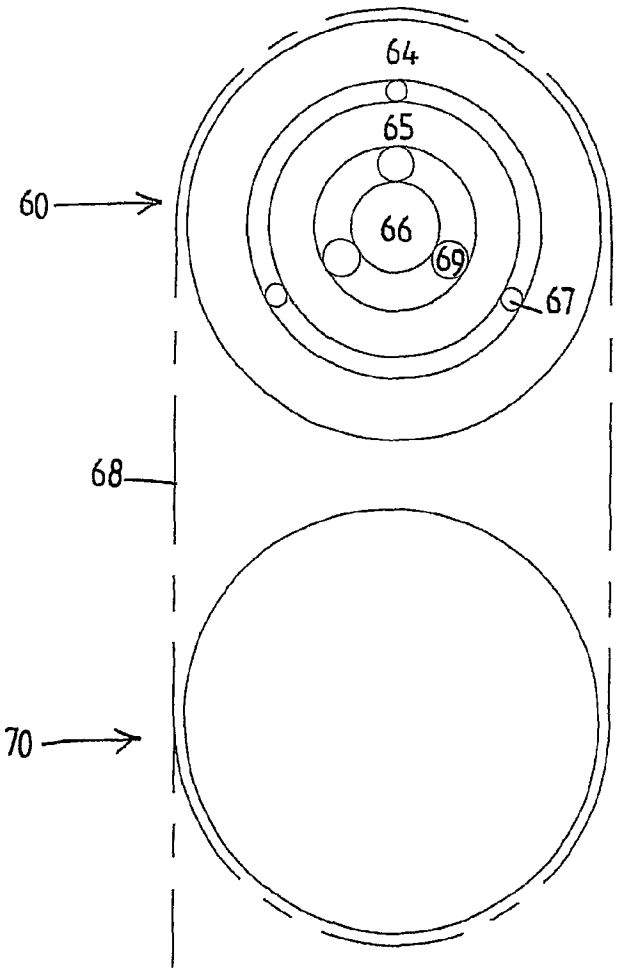
Fig.3A

TRACTION WINCH

The present invention relates to a traction winch for a cable or the like, said winch comprising a winch frame, at least two sheave assemblies each having at least a first sheave and a second sheave, each sheave having a single circumferential friction surface for the cable, at least two rotatable driveshafts, journalled in the winch frame in a side-by-side arrangement, each drive shaft being associated with a sheave assembly and at least one motor for driving the driveshafts.

Known winches of this kind are used for the retrieval of elongated bodies such as cables. In particularly, the invention relates to winches intended to haul very heavy loads by means of a cable, a not inconsiderable part of the load being often constituted by the weight of the cable, generally a cable of large diameter and of very great length. The invention also concerns the application of such a winch to off-shore technologies, e.g. for abandonment and recovery applications, oceanography and dredging at great depths. A problem of known traction winches is that cables wear rapidly. Under load fibre rope stretches which causes the cable to slip and the sheave to spin. This causes heat development which results in wear. This may be in particularly disadvantageous for high-tech cables.

In U.S. Pat. No. 6,182,915 a solution is presented according to which all sheaves are driven separately. In U.S. Pat. No. 7,175,163 an alternative solution is presented according to which the sheaves slip relatively with respect to a centrally provided drum.

It is an object of the present invention to provide yet an alternative traction winch which prevents slippage and wear of the cables over the sheaves upon elongation of the cable.

The winch of the invention includes a differential assembly being provided between each driveshaft and sheave assembly so as to allow for different rotational speeds of the sheaves during operation of the traction winch due to cable elongation.

Preferably, a differential gear assembly is provided. It is noted that other known differential assemblies are less preferred, but may also be applied.

The traction winch according to the invention is beneficial since it enables handling any type of rope, e.g. lightweight rope, fibre rope and cables in a very careful manner, without causing damage. The use of fibre rope is particularly beneficial when large ends are required, e.g. for use in deep water, because of its properties being as strong as steel wire but only a fraction of the weight. This means that lightweight fibre rope can handle a substantially better payload in deep water, and, due to its low weight, winches an handling equipment may be applied with much smaller power requirements and dimensions than for steel wire. As a result, energy and space consumption of traction winches on offshore equipment is reduced. Because of the differential assembly, slipping between rope and sheave is prevented which slipping develops heat and causes wear. Hence, it is possible to use lightweight rope in deep water, e.g. for lowering equipment and placing equipment on the bottom of the sea. The traction winch according to the invention enables an increase in lifting capacity, and hence lifting in increased water depths. The traction winch according to the invention may alternatively be applied for mooring purposes.

Preferred embodiments of the invention as well as the advantages and essential details thereof are disclosed in the drawing and the description and the claims which follow.

The invention will be explained in more detail with reference to the drawing, in which:

FIGS. 1*a* and 1*b* show schematic details of a first embodiment of a traction winch according to the invention;

FIGS. 2*a* and 2*b* show schematic details of a second embodiment of a traction winch according to the invention;

FIG. 2*c* shows a schematic detail of a third embodiment of a traction winch according to the invention;

FIGS. 3*a*-3*c* show schematic details of a fourth embodiment of a traction winch according to the invention;

Figure 1A:
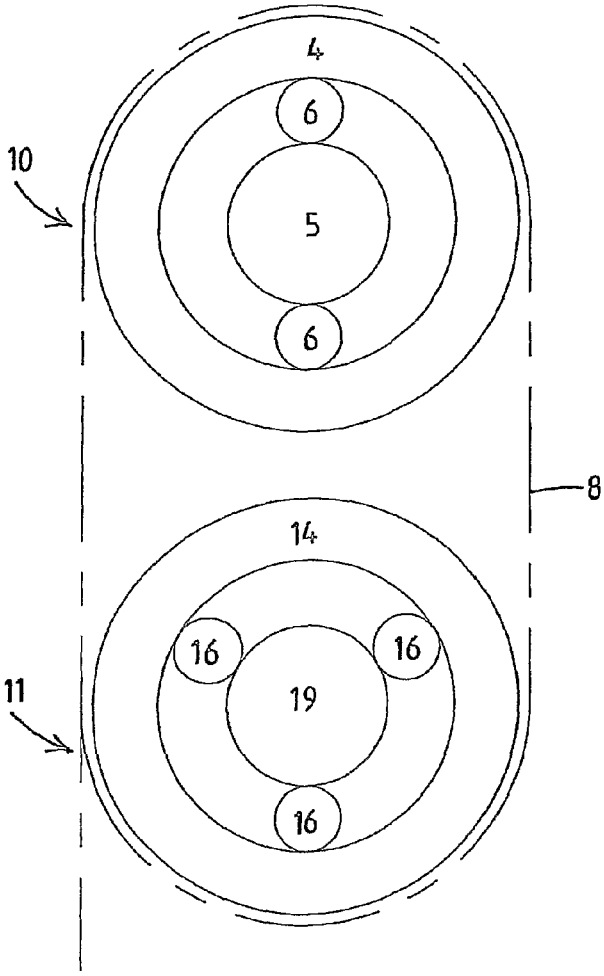
Figure 1B:
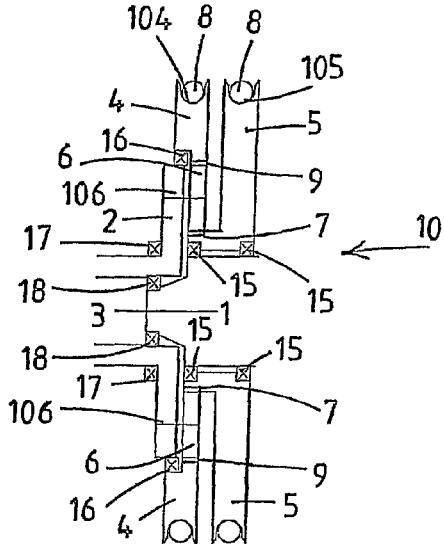

In FIG. 1 a traction winch according to the invention is partly shown. FIG. 1*a* is a schematical view of the operation of a differential gear assembly according to the invention, and FIG. 1*b* shows a cross-section of a differential gear assembly provided between a driveshaft and a sheave assembly.

In FIG. 1 a cable 8 is provided over two sheave assemblies 10, 11. Upper sheave assembly 10 is shown in cross section in FIG. 1*b*. The sheave assembly 10 comprises a first sheave 4 and a second sheave 5, in the shown embodiment provided around a shaft 1, which may be provided stationary. Each sheave 4, 5 has a single circumferential friction surface 104, 105 for the cable 8. In analogy sheave assembly 11 comprises a first sheave 14 and a second sheave 19, only part of which is shown in FIG. 1*a*. These sheaves 14, 19 also have a single circumferential friction surface for the cable 8.

A rotatable driveshaft 3 is associated with sheave assembly 10. In analogy, a rotatable driveshaft (not shown) is associated with sheave assembly 11. Both driveshafts are journalled in the winch frame in a side-by-side arrangement. At least one motor is provided for driving each of the driveshafts.

Between driveshaft 3 and sheave assembly 10 according to the invention a differential gear assembly is provided so as to allow for different rotational speeds of the sheaves during operation of the traction winch due to cable elongation.

In the preferred embodiment shown in FIG. 1, the differential gear assembly is formed by the first sheave 4 being integral with a ring gear, the teeth of which are indicated by part 9, and the second sheave 5 being integral with a central gear, the teeth of which are indicated by part 7. Between the first sheave 4 (ring gear teeth 9) and the second sheave 5 (central gear teeth 7), and meshing therewith, are arranged two planetary gears 6. In analogy, first sheave 14 of second sheave assembly 11 is formed integral with a ring gear and second sheave 19 is formed integral with a central gear, between which three planetary gears 16 are provided. Any other suitable number of planetary gears may be provided.

In the embodiment shown in FIG. 1*b*, the driveshaft 3 is provided with a carrier 2 which rotatably supports the two planetary gears 6 via axles 106.

Bearings 15 are provided between sheave 5 and stationary shaft 1, bearings 16 are provided between sheave 4 and carrier 2 and bearings 18 are provided between driveshaft 3 and shaft 1. Bearings 17 next to carrier 2 are provided to fix the carrier 2.

Figure 2A:
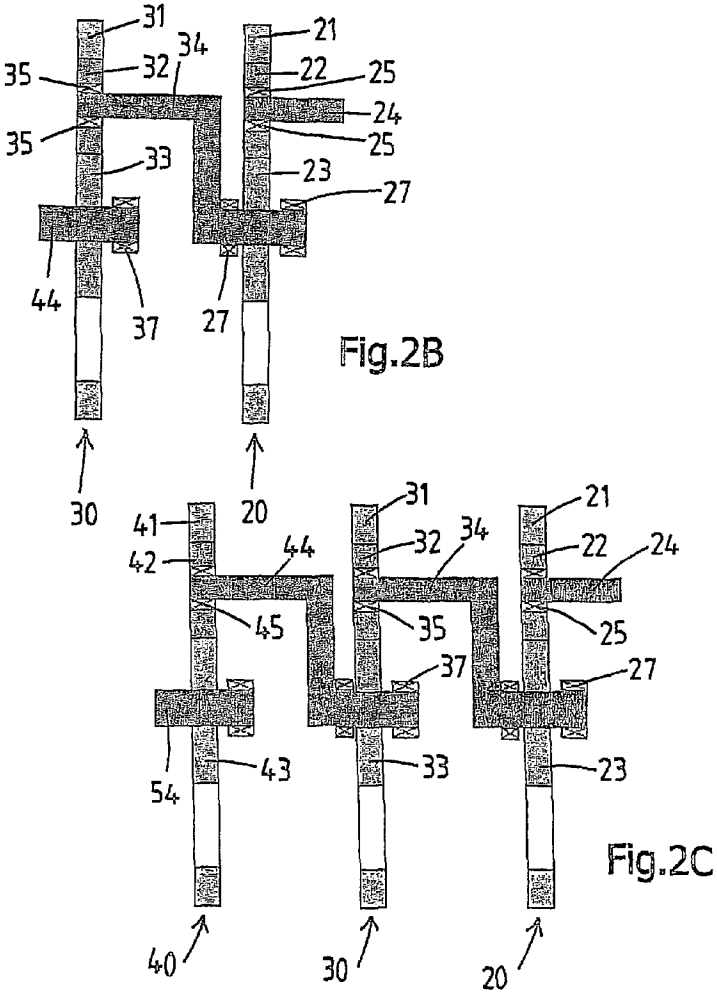
Figure 2A:
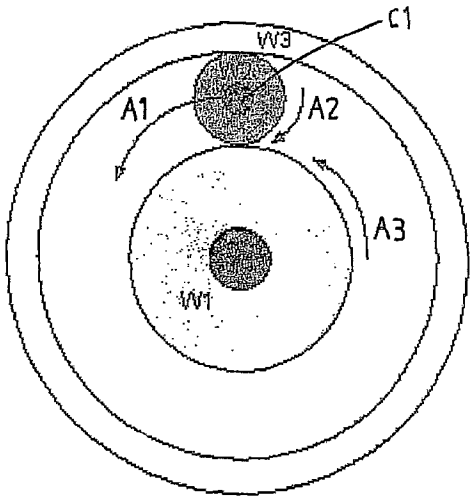

The operation of a planetary gear in a differential gear assembly is elucidated in FIG. 2*a*. Planetary gear W2 is provided between, and meshing with, a ring gear W3 and a central gear W1. Planetary gear W2 is rotatable within the track defined between W1 and W2, indicated by arrow A1, by moving its central axis C1. This rotation may e.g. be performed by a carrier such as carrier 2 shown in FIG. 1*b*, connected to an axle in central axis C1. Planetary gear W2 is also rotatable about its own central axis C1 as indicated by arrow A2. Without any resistance of W1 or W3, or with infinite resistance between W2 and its central axis C1, rotation of planetary gear W2 in the direction A1 will cause all gears W1, W2 and W3 to rotate with the same angular velocity. When, e.g., W3 is suspected to any resistance, W2 will start to roll over W3 and rotate about its central axis C1 in the direction of arrow A2. This causes W1 to rotate in the direction A3 relative to W3, resulting in a rotational speed difference between W1 and W3.

In the embodiment shown in FIG. 1, first sheave 4 is integral with a ring gear similar to W3, and second sheave 5 is integral with a central gear similar to W1. Planetary gears 6 resemble W2. When for example a wire enters sheave 4 with a length of 1 m, it may elongate e.g. to 1.5 m due to tension increase over the sheave 1. So the first sheave 4 has to rotate to move 1 m and the second sheave 5 has to rotate to move 1.5 m. So sheave 5 needs to rotate faster, which is accomplished by the differential gear assembly comprising the planetary gears 6, which cause meshing central gear 5 to have a larger rotational speed than meshing ring gear 4.

In FIG. 2*b* a slightly different operating differential gear assembly is indicated. This differential gear assembly comprises two similar gear sets 20,30 of a ring gear 21,31, planetary gear 22,32 and central gear 23,33. Planetary gears 22, 32 are rotatable about their central axis via bearings 25, 35. Axle 24 of planetary gear 22 is driven, e.g. by a carrier (not shown). This causes ring gear 21 and central gear 23 to rotate. A sheave (not shown) may be coupled to, or formed integral with first ring gear 21. Axle 34 of planetary gear 32 is driven by the rotational movement of central gear 23. Axle 34 is fixed in the central axis of central gear 23 and supported by bearings 27.

Driving planetary gear 32 causes ring gear 31 and central gear 33 to rotate. A second sheave (not shown) may be coupled to, or formed integral with second ring gear 31. The shown differential gear assembly allows for different rotational speeds of the ring gears 21, 31, and hence of the connected or integral sheaves (not shown).

A third axle 44 is shown in bearing 37, connected to central gear 33. These features are redundant in case only two sheaves are provided in the sheave assembly. A third sheave may be connected to the shown axle 44 of the second central gear 33, operating similar to sheave 5 shown in FIG. 1*b*. This is in fact the situation shown in FIG. 3.

In FIG. 2*c* the same differential gear assembly principle as shown in FIG. 2*b* is continues with a third gear set 40 similar to gear sets 20,30 comprising a ring gear 41 to which a third sheave may be connected or integrally formed with, a planetary gear 42 and central gear 43. Planetary gear 42 is rotatable via bearings 45 and axle 44, which axle 44 is connected with central gear 33 of second gear set 30. The gear assembly may be even further continued with the installation of a fourth gear set coupled to axle 54 connected with central gear 43 of third gear set 40, and likewise be continued.

Yet an alternative differential gear assembly is shown in FIG. 3. In FIG. 3*a* a cable 68 is provided over two sheave assemblies 60, 70. Upper sheave assembly 60 is shown in side view in FIG. 3*b* and schematically in FIG. 3*c*. Lower sheave assembly 70 is not elucidated further but is of identical design. The sheave assembly 60 comprises a first sheave 64, second sheave 65, and third sheave 66, in the shown embodiment provided around a central axis 61. Each sheave 64, 65, 66 has a single circumferential friction surface for the cable 68.

In the embodiment shown in FIG. 3, the differential gear assembly is formed by the first sheave 64 being integral with a first ring gear, the second sheave 65 being integral with a second ring gear, and third sheave 66 being integral with a second central gear. Between first ring gear 64 and first central gear 62, and meshing therewith, are three first planetary gears 67 arranged. Between second ring gear 65 and second central gear 66, and meshing therewith, are three second planetary gears 69 arranged. A carrier (not shown) may rotatably support the three first planetary gears 67 via axles 63. Second planetary gears 69 are driven by first central gear 62 via axles 71 in the central axis of the planetary gears 69.

Figure 4:
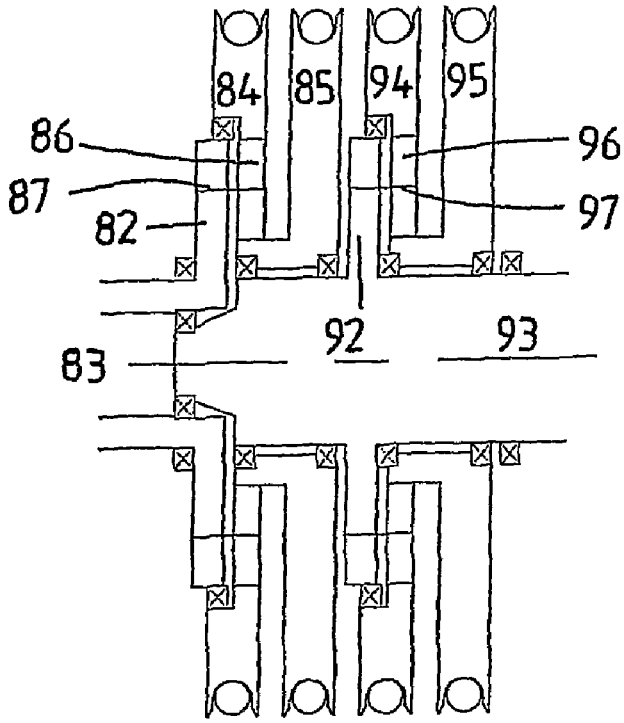
FIG. 4 shows a schematic detail of a fifth embodiment of a traction winch according to the invention.

An alternative embodiment is shown in FIG. 4. A traction winch according to the invention may comprise four sheave assemblies arranged in pairs, and four driveshafts arranged in pairs, each pair on a common axis. Between each driveshaft and associated sheave assembly a differential gear assembly is provided, which is shown in FIG. 4. Driveshaft 83 rotates carrier 82 which drives planetary gear 86 via axle 87. Planetary gear 86 drives first sheave 84 and second sheave 85, analogous to the operation shown in FIG. 1*b*. The shaft 93 in FIG. 4 is a second driveshaft, which rotates carrier 92 which in turn drives planetary gear 96 via axle 97. Planetary gear 96 drives third sheave 94 and fourth sheave 95.

Figure 5:
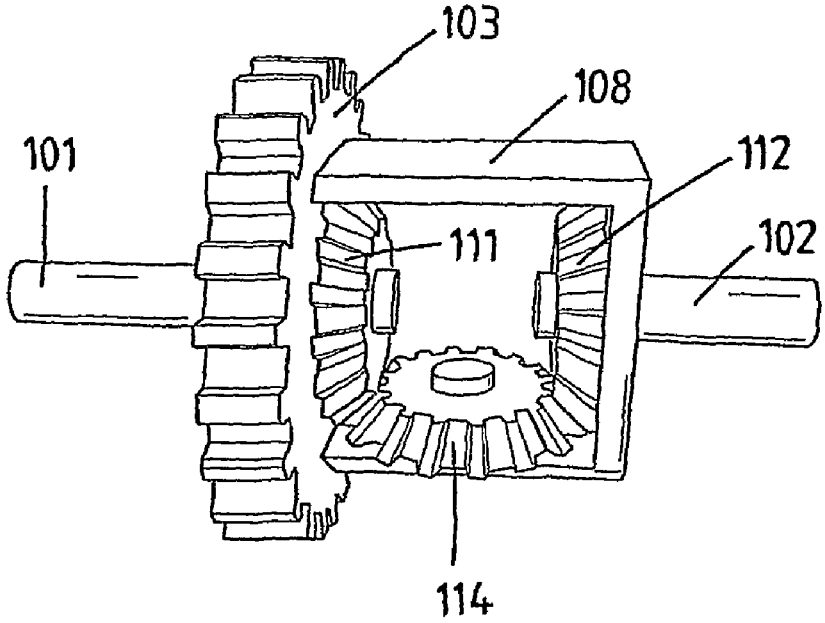
FIG. 5 shows a schematic detail of a sixth embodiment of a traction winch according to the invention.

The principle of yet an alternative a differential gear assembly is shown in FIG. 5. A traction winch for a cable according to the invention comprises a winch frame and at least two sheave assemblies each having at least a first sheave and a second sheave, each sheave having a single circumferential friction surface for the cable. Upon assembly, the first and second sheave are connected to shown axles 101, 102. Rotatable drive gear 103 is journalled in the winch frame and driven by a motor. A carrier 108 integral with rotatable drive gear 103 drives primary gear 111 and secondary gear 112 which are connected to the first and second sheave (not shown) via axles 101 and 102. A planetary gear 114 is provided between primary gear 101*a* and secondary gear 102*a* so as to allow for different rotational speeds of the sheaves during operation of the traction winch due to cable elongation.

Figure 6:
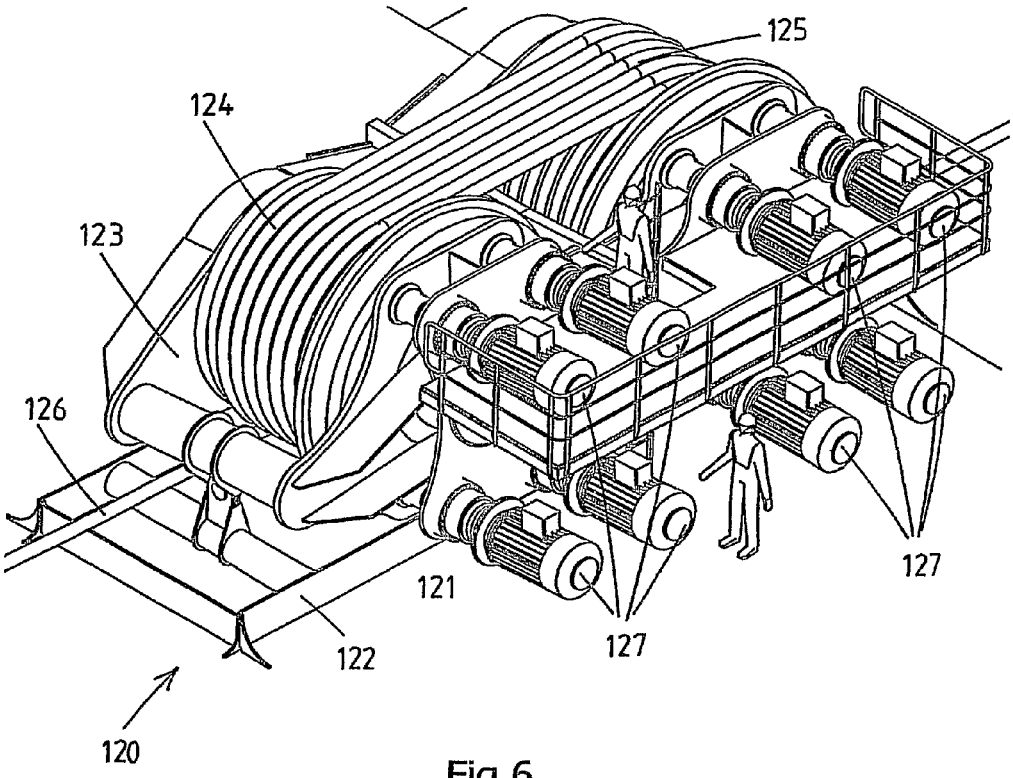
FIG. 6 shows a schematic perspective view of a traction winch according to the invention.

In FIG. 6 a traction winch 120 is schematically shown. Traction winch 120 is provided on a deck 121 on a frame 122. The shown winch 120 comprises a winch frame 122, 123 and at least two sheave assemblies 124, 125, each having at multiple sheaves having circumferential friction surfaces for cable 126. Two rotatable driveshafts (not visible per se) are journalled in the winch frame in a side-by-side arrangement, each drive shaft being associated with a sheave assembly 124, 125. Four motors 127 are provided for driving each driveshaft, driving the driveshaft via a gear assembly (not shown).

| | |
|---|---|
| 1 | shaft |
| 2 | carrier |
| 3 | driveshaft |
| 4 | first sheave |
| 5 | second sheave |
| 6 | planetary gear |
| 7 | teeth of central gear |
| 8 | cable |
| 9 | teeth of ring gear |
| 10 | sheave assembly |
| 11 | sheave assembly |
| 14 | first sheave |
| 15 | bearing |
| 16 | bearing |
| 17 | bearing |
| 18 | bearing |
| 19 | second sheave |
| 20 | gear set |
| 21 | ring gear |
| 22 | planetary gear |

-continued

| | |
|---|---|
| 23 | central gear |
| 24 | axle |
| 25 | bearing |
| 30 | gear set |
| 31 | ring gear |
| 32 | planetary gear |
| 33 | central gear |
| 34 | axle |
| 35 | bearing |
| 40 | gear set |
| 41 | ring gear |
| 42 | planetary gear |
| 43 | central gear |
| 44 | axle |
| 45 | bearing |
| 54 | axle |
| 60 | sheave assembly |
| 61 | central axis |
| 62 | central gear |
| 63 | axle |
| 64 | first sheave |
| 65 | second sheave |
| 66 | third sheave |
| 67 | planetary gear |
| 68 | cable |
| 69 | planetary gear |
| 70 | sheave assembly |
| 71 | axle |
| 82 | carrier |
| 83 | driveshaft |
| 84 | first sheave |
| 85 | second sheave |
| 86 | planetary gear |
| 87 | axle |
| 92 | carrier |
| 93 | shaft |
| 94 | third sheave |
| 95 | fourth sheave |
| 96 | planetary gear |
| 97 | axle |
| 101 | axle |
| 102 | axle |
| 103 | drive gear |
| 104 | circumferential friction surface |
| 105 | circumferential friction surface |
| 106 | axle |
| 111 | primary gear |
| 112 | secondary gear |
| 114 | planetary gear |
| 120 | traction winch |
| 121 | deck |
| 122 | frame |
| 123 | frame |
| 124 | sheave assembly |
| 125 | sheave assembly |
| 126 | cable |
| 127 | motors |
| W1 | central gear |
| W2 | planetary gear |
| W3 | ring gear |
| A1 | arrow |
| A2 | arrow |
| A3 | arrow |
| C1 | central axis |

The invention claimed is:

1. A traction winch for a cable or the like, said winch comprising:

a winch frame;

at least two sheave assemblies each having at least a first sheave and a second sheave, each sheave having a single circumferential friction surface for the cable;

at least two rotatable driveshafts, journalled in the winch frame in a side-by-side arrangement, each drive shaft being associated with a sheave assembly;

at least one motor for driving the driveshafts; and a differential gear assembly being provided between each driveshaft and sheave assembly so as to allow for different rotational speeds of the sheaves during operation of the traction winch due to cable elongation, wherein the differential gear assembly is formed by a ring gear and a central gear and at least one planetary gear being arranged between the ring gear and the central gear and meshing therewith, wherein the first sheave is integral with the ring gear, and the second sheave is integral with the central gear.

2. The traction winch according to claim 1, wherein the at least two drive shafts are provided with a carrier rotatably supporting the at least one planetary gear.

3. The traction winch according to claim 2, wherein the traction winch comprises four sheave assemblies arranged in pairs, and wherein the traction winch has four driveshafts arranged in pairs, each pair on a common axis, and wherein between each driveshaft and associated sheave assembly a differential gear assembly is provided.

4. The traction winch according to claim 2, wherein all driveshafts present are driven by a separate motor.

5. The traction winch according to claim 1, wherein the traction winch comprises four sheave assemblies arranged in pairs, and wherein the traction winch has four driveshafts arranged in pairs, each pair on a common axis, and wherein between each driveshaft and associated sheave assembly a differential gear assembly is provided.

6. The traction winch according to claim 1, wherein all driveshafts present are driven by a separate motor.

7. A traction winch for a cable or the like, said winch comprising:

a winch frame;

at least two sheave assemblies each having at least a first sheave and a second sheave, each sheave having a single circumferential friction surface for the cable;

at least two rotatable driveshafts, journalled in the winch frame in a side-by-side arrangement, each drive shaft being associated with a sheave assembly;

at least one motor for driving the driveshafts; and a differential gear assembly being provided between each driveshaft and sheave assembly so as to allow for different rotational speeds of the sheaves during operation of the traction winch due to cable elongation, wherein the differential gear assembly is formed by a primary and secondary gear and at least one planetary gear being arranged between the primary gear and the secondary gear and meshing therewith, wherein the first sheave is connected to the primary gear and the second sheave is connected to the secondary gear.

8. The traction winch according to claim 7, wherein the at least two drive shafts are provided with a carrier rotatably supporting the at least one planetary gear.

9. The traction winch according to claim 7, wherein the traction winch comprises four sheave assemblies arranged in pairs, and wherein the traction winch has four driveshafts arranged in pairs, each pair on a common axis, and wherein between each driveshaft and associated sheave assembly a differential gear assembly is provided.

10. The traction winch according to claim 7, wherein all driveshafts present are driven by a separate motor.

11. A traction winch for a cable or the like, said winch comprising:

a winch frame;

at least two sheave assemblies each having at least a first sheave and a second sheave, each sheave having a single circumferential friction surface for the cable;

at least two rotatable driveshafts, journalled in the winch frame in a side-by-side arrangement, each drive shaft being associated with a sheave assembly;

at least one motor for driving the driveshafts; and a differential gear assembly being provided between each driveshaft and sheave assembly so as to allow for different rotational speeds of the sheaves during operation of the traction winch due to cable elongation, wherein the differential gear assembly is formed by:

the first sheave being integral with a first ring gear;

the second sheave being integral with a second ring gear;

a first central gear;

a second central gear;

at least one first planetary gear being arranged between the first ring gear and the first central gear and meshing therewith; and at least one second planetary gear being arranged between the second ring gear and the second central gear and meshing therewith, which second planetary gear is supported by a second carrier connected to the first central gear.

12. The traction winch according to claim 11, in which the sheave assemblies are provided with a third sheave being integral with the second central gear.

13. The traction winch according to claim 12, wherein the traction winch comprises four sheave assemblies arranged in pairs, and wherein the traction winch has four driveshafts arranged in pairs, each pair on a common axis, and wherein between each driveshaft and associated sheave assembly a differential gear assembly is provided.

14. The traction winch according to claim 12, wherein all driveshafts present are driven by a separate motor.

15. The traction winch according to claim 11, in which the sheave assemblies are provided with a third sheave, and the differential gear assembly is further formed by:

the third sheave being integral with a third ring gear, a third central gear, at least one third planetary gear being arranged between the third ring gear and the third central gear and meshing therewith, which third planetary gear is supported by a third carrier connected to the second central gear.

16. The traction winch according to claim 15, wherein the traction winch comprises four sheave assemblies arranged in pairs, and wherein the traction winch has four driveshafts arranged in pairs, each pair on a common axis, and wherein between each driveshaft and associated sheave assembly a differential gear assembly is provided.

17. The traction winch according to claim 15, wherein all driveshafts present are driven by a separate motor.

18. The traction winch according to claim 11, wherein the traction winch comprises four sheave assemblies arranged in pairs, and wherein the traction winch has four driveshafts arranged in pairs, each pair on a common axis, and wherein between each driveshaft and associated sheave assembly a differential gear assembly is provided.

19. The traction winch according to claim 11, wherein all driveshafts present are driven by a separate motor.

* * * * *